US007959313B2

(12) United States Patent
Park et al.

(10) Patent No.: US 7,959,313 B2
(45) Date of Patent: Jun. 14, 2011

(54) REFRIGERATOR

(75) Inventors: Eun-seong Park, Jeonju-si (KR); Young-gwi Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 518 days.

(21) Appl. No.: 12/149,170

(22) Filed: Apr. 28, 2008

(65) Prior Publication Data

US 2009/0052160 A1 Feb. 26, 2009

(30) Foreign Application Priority Data

Aug. 23, 2007 (KR) ..... 10-2007-0085072
Dec. 13, 2007 (KR) ..... 10-2007-0129859

(51) Int. Cl.
*F21V 33/00* (2006.01)

(52) U.S. Cl. ..... 362/92; 362/231; 362/253; 62/264

(58) Field of Classification Search ..... 362/92, 362/253, 234, 231; 62/264
See application file for complete search history.

(56) References Cited

U.S. PATENT DOCUMENTS

| | | | | |
|---|---|---|---|---|
| 6,873,262 | B2 * | 3/2005 | Midlang | 340/585 |
| 7,670,018 | B2 * | 3/2010 | Kim et al. | 362/92 |
| 2007/0044497 | A1 * | 3/2007 | Roo et al. | 62/264 |

FOREIGN PATENT DOCUMENTS

| | | |
|---|---|---|
| JP | 2004-286333 | 10/2004 |
| JP | 2007-003061 | 1/2007 |
| KR | 1998-013792 | 6/1998 |
| KR | 10-2007-0008304 | 1/2007 |

* cited by examiner

*Primary Examiner* — Laura Tso
(74) *Attorney, Agent, or Firm* — Staas & Halsey LLP

(57) ABSTRACT

A refrigerator which has a main body cabinet forming at least one storage chamber therein, the refrigerator includes: an illuminator provided in the storage chamber and illuminating an inside of the storage chamber; an input unit provided to set at least one of a color, a hue saturation and a brightness of the illuminator; and a controller storing a setting value set through the input unit and controlling the illuminator according to the setting value.

5 Claims, 5 Drawing Sheets

REFRIGERATOR

CROSS-REFERENCE TO RELATED APPLICATIONS

This application claims priority from Korean Patent Application No. 10-2007-0085072, filed on Aug. 23, 2007, in the Korean Intellectual Property Office, and Korean Patent Application No. 10-2007-0129859, filed on Dec. 13, 2007, in the Korean Intellectual Property Office, the disclosures of which are incorporated herein by reference.

BACKGROUND

1. Field

Apparatuses consistent with the present invention relate to a refrigerator, and more particularly, to a refrigerator which easily adjusts an illumination of a storage chamber according to a user's preference.

2. Description of the Related Art

A refrigerator cools a storage chamber with a cooling cycle to thereby cool stored items or cause them not to deteriorate.

Generally, the refrigerator includes therein a storage chamber, such as a freezing compartment or a refrigerating compartment.

Internal lights are installed in an upper wall and a rear wall of the storage chamber and are turned on and off by opening and closing a door switch provided in a front surface of the refrigerator.

The internal lights are turned on by an opening signal of the door switch to illuminate the storage chamber to thereby easily take out items therefrom or put items therein.

The internal lights of a conventional refrigerator have only one color to simply illuminate the storage chamber.

Thus, a user may not adjust an illumination color of the storage chamber according to his/her preference since the illumination color is set during a manufacturing process. That means user friendliness is lowered and an emotional quality of a user is decreased.

SUMMARY

Accordingly, it is an aspect of the present embodiments to provide a refrigerator which easily adjusts an illumination of a storage chamber according to a user's preference, is highly user-friendly and enhances a user's emotional quality.

Also, it is another aspect of the present embodiments to provide a refrigerator which has different illuminations of an illuminator according to a temperature of a storage chamber to easily determine a temperature state of the storage room.

Additional aspects and/or advantages will be set forth in part in the description which follows and, in part, will be obvious from the description, or may be learned by practice of the present invention.

The foregoing and/or other aspects are also achieved by providing a refrigerator, including: a main body cabinet forming at least one storage chamber therein to store items to be cooled; at least one illuminator provided in the storage chamber and illuminating an inside of the storage chamber; an input unit setting at least one of a color, a hue saturation and a brightness of the illuminator; and a controller storing at least one setting value set through the input unit and controlling the illuminator according to the at least one setting value.

The refrigerator may further include a temperature detector detecting a temperature of the storage chamber, wherein the at least one illuminator has at least one setting value of color, hue saturation and brightness changed according to a temperature input through the input unit and illuminates the storage chamber corresponding thereto.

The at least one illuminator may include a plurality of light emitters, each light emitter emitting a different color of light, and the controller may control the at least one illuminator to illuminate the storage chamber in different colors according to the at least one setting value set through the input unit.

The input unit may set the brightness of the at least one illuminator to vary depending on at least one of daytime, nighttime and power consumption.

The input unit may set the color of the at least one illuminator to vary depending on at least one of temperature, storage chamber, time and season.

The at least one illuminator may include a plurality of light emitters, each light emitter emitting a different color of light, and the input unit may set the hue saturation of the at least one illuminator to vary depending on at least one of temperature, storage chamber, day or night, and season.

The foregoing and/or other aspects are achieved by providing a refrigerator, including: a main body including at least one storage chamber therein to store items to be cooled; an input unit receiving an input from a user to set at least one of a color, a hue saturation and a brightness of the illuminator; and at least one illuminator disposed within the storage chamber, the at least one illuminator being controlled to illuminate in at least one of the color, the hue saturation and the brightness based on a setting value.

The setting value may be set according to a temperature of the at least one storage chamber.

The setting value may be a range of temperature set to correspond to at least one of the color, the hue saturation and the brightness of the illuminator in order to convey a temperature range of the temperature of the least one storage chamber.

The at least one illuminator may illuminate in a plurality of colors, each color being illuminated based on the setting value set according to the temperature of the at least one storage chamber.

The at least one storage chamber may include a refrigerating chamber and a freezing chamber, each of the refrigerating chamber and the freezing chamber including an illuminator illuminating in at least one of the color, the hue saturation and the brightness based on the setting value set according to the temperature of the refrigerating chamber and the freezing chamber, respectively.

The at least one illuminator may include a plurality of light emitters, each of the light emitters emitting at least one of a different color of light, a different level of hue saturation or a different level of brightness.

BRIEF DESCRIPTION OF THE DRAWINGS

The above and/or other aspects will become apparent and more readily appreciated from the following description of the embodiments, taken in conjunction with the accompanying drawings of which.

DETAILED DESCRIPTION OF THE EMBODIMENTS

Figure 1:
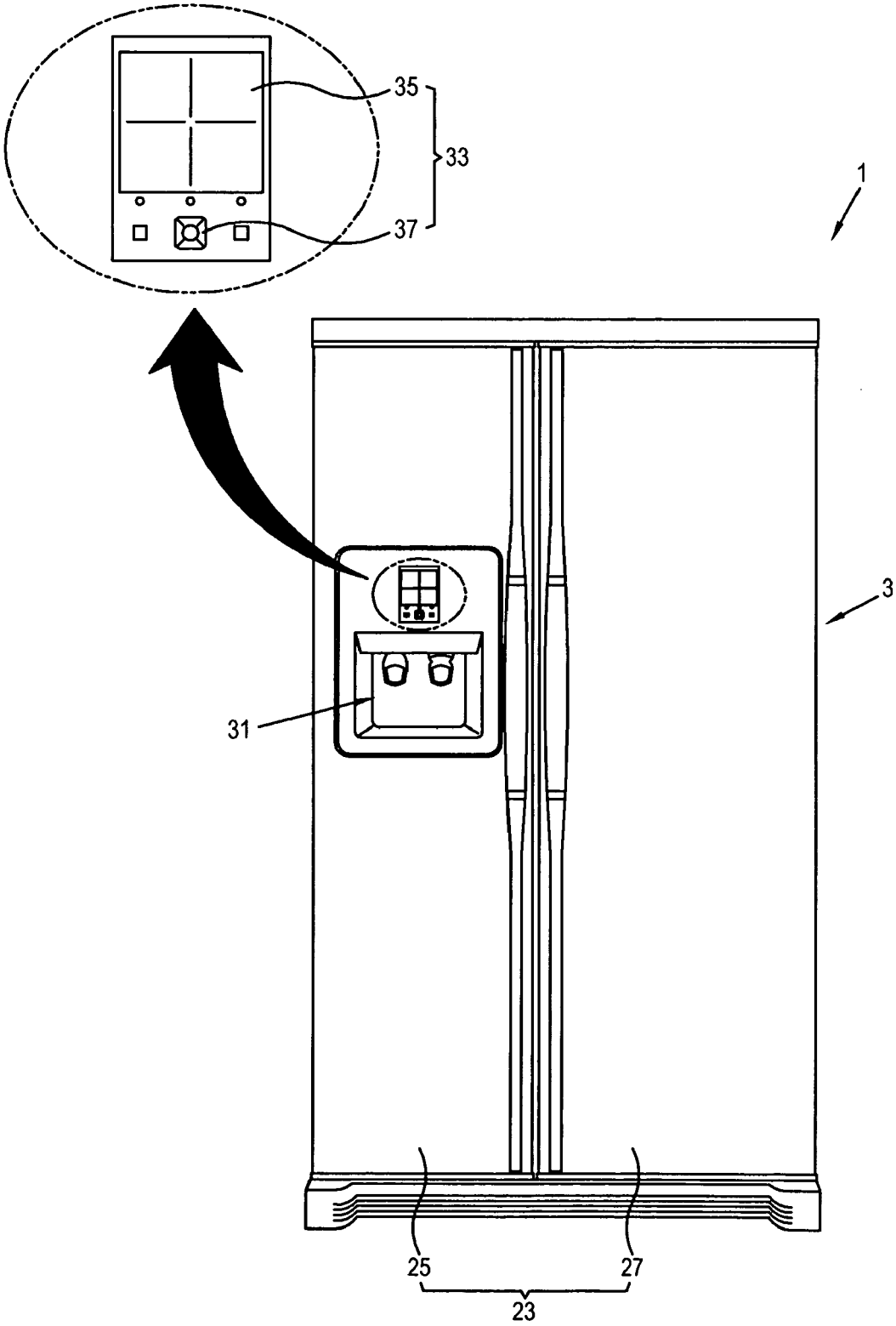
FIG. 1 is a perspective view of a refrigerator according to a first embodiment.
Figure 2:
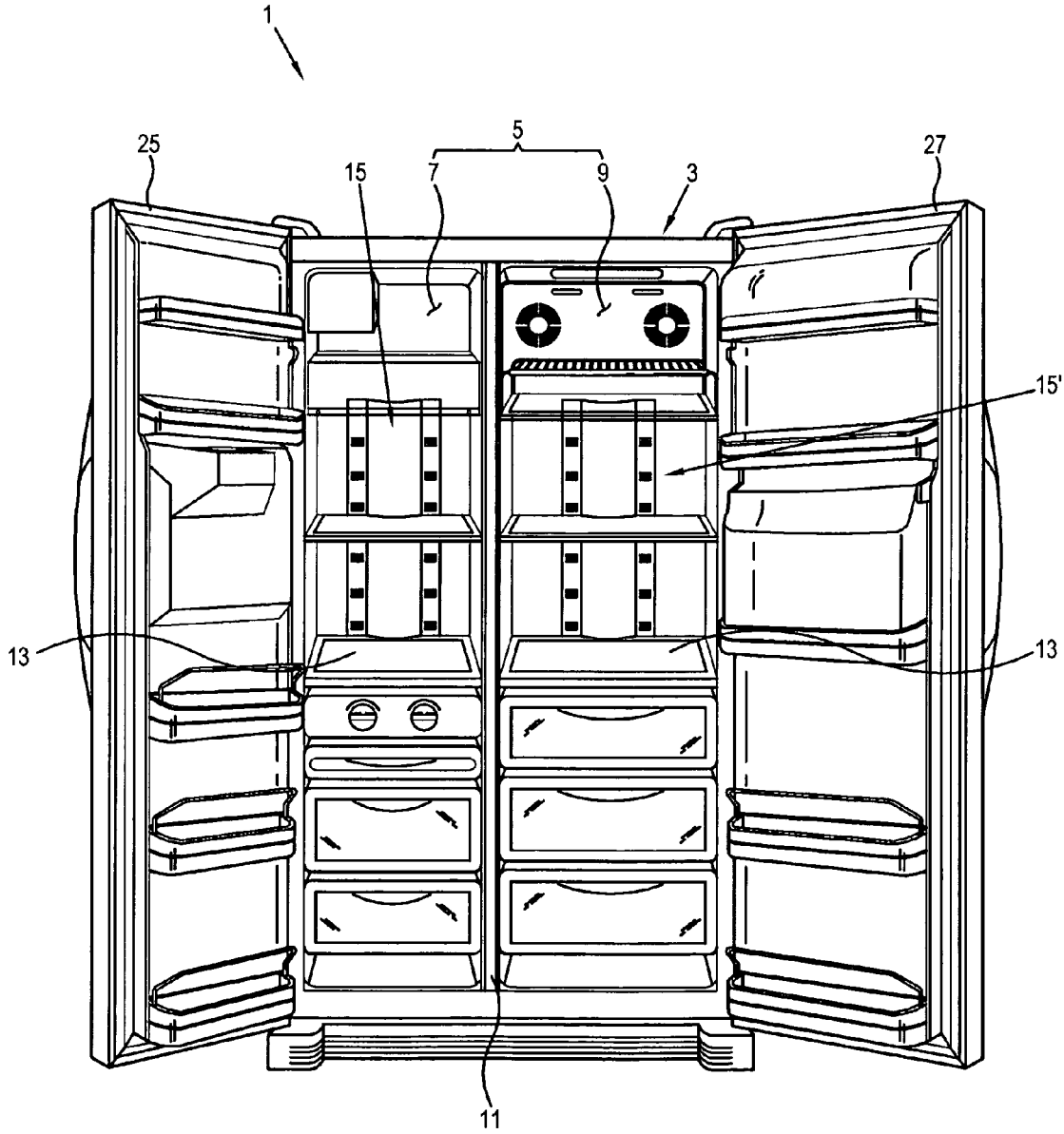
FIG. 2 is a perspective view of the refrigerator when a door is open in FIG. 1.
Figure 3:
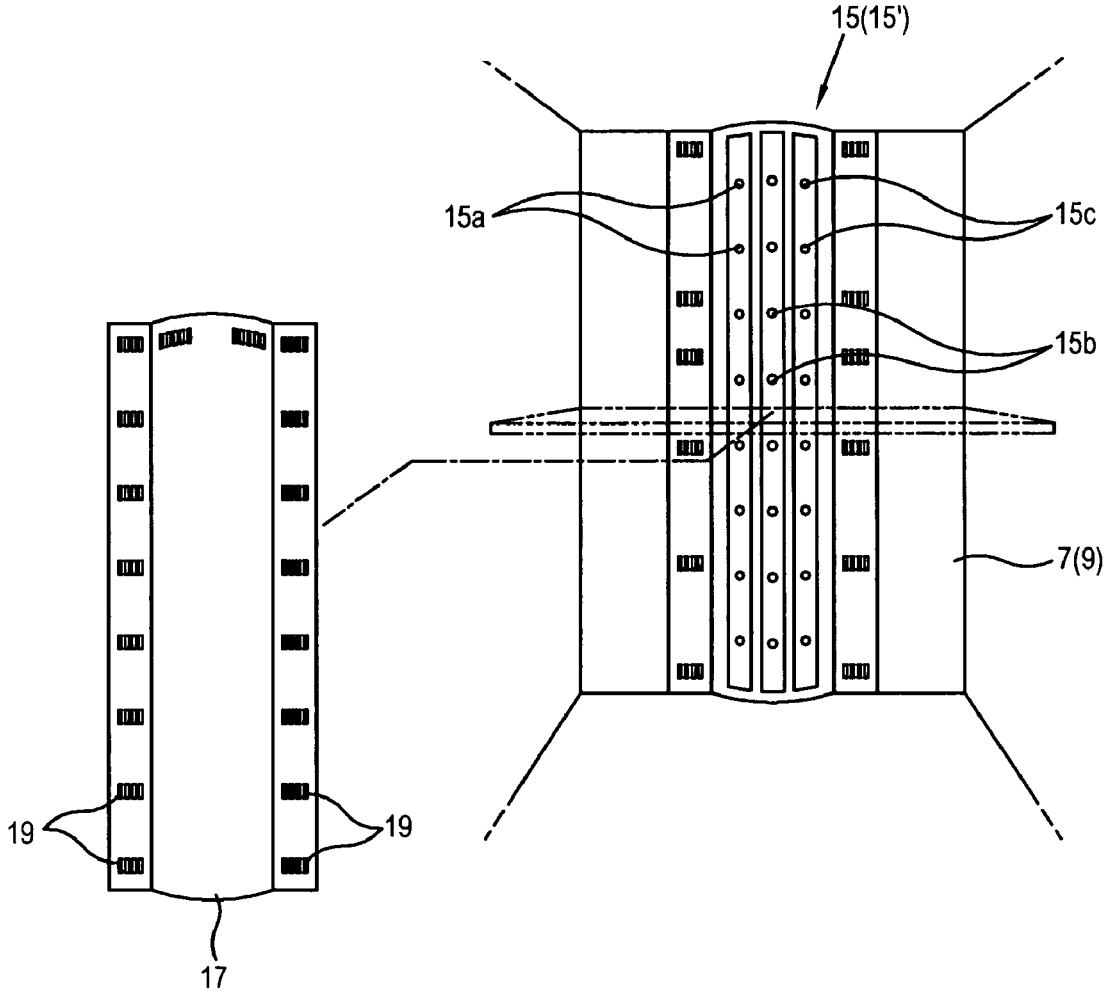
FIG. 3 is an exploded perspective view of the refrigerator in FIG. 1.
Figure 4:
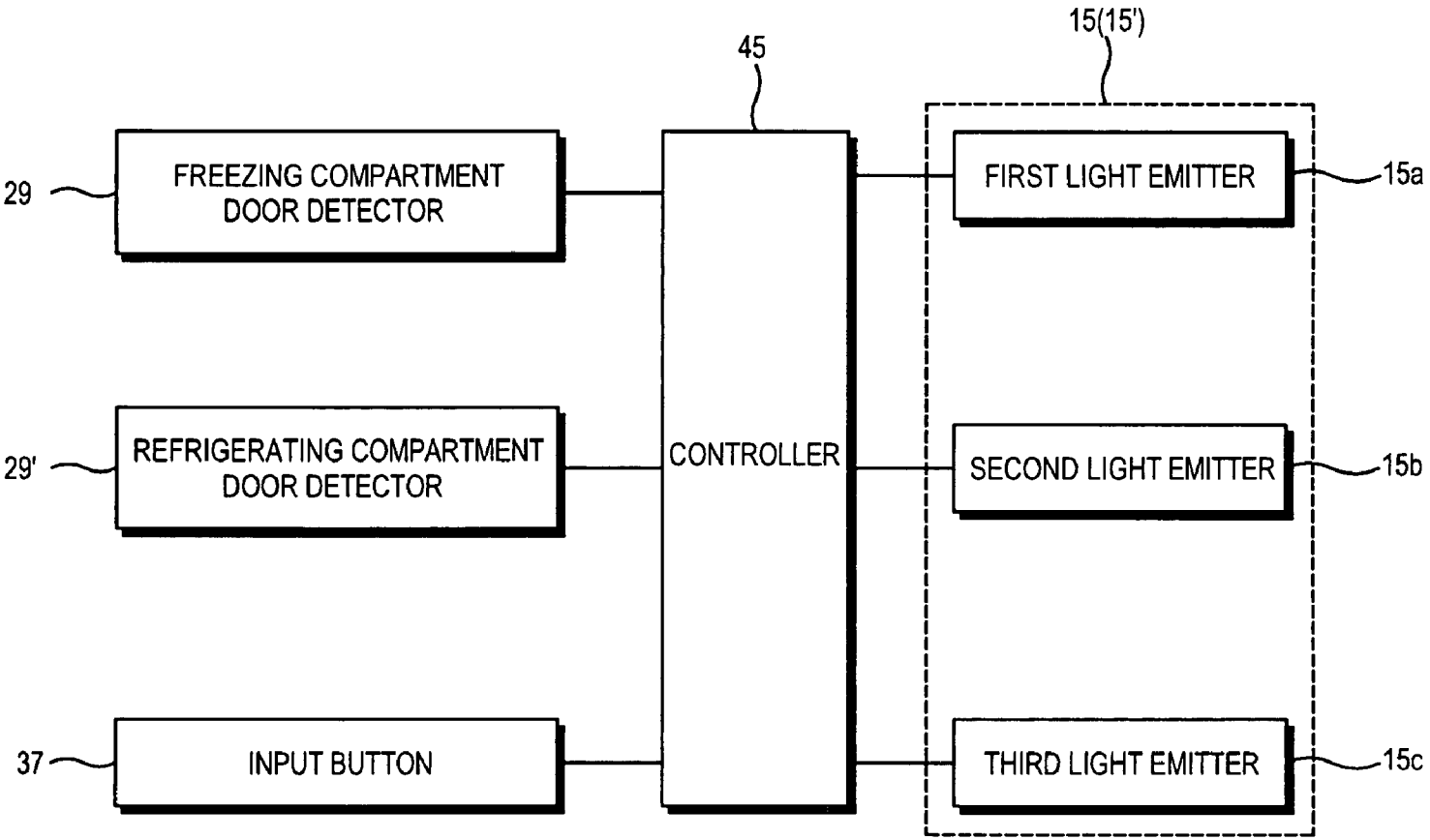
FIG. 4 is a control block diagram of the refrigerator according to the first embodiment.

Hereinafter, embodiments of the present invention will be described with reference to accompanying drawings, wherein like numerals refer to like elements and repetitive descriptions will be avoided as necessary.

Hereinafter, a side-by-side refrigerator will be described in detail.

The present embodiments are not limited to the side-by-side refrigerator. Alternatively, the present embodiments may be applicable to a top-mounted freezer (TMF) and a bottom-mounted freezer (BMF). Further, the present embodiments may be applicable to an electronic device, such as a wine refrigerator and a kimchi refrigerator, which maintains a low temperature.

As shown in FIGS. 1 to 4, a refrigerator 1 according to a first embodiment includes a main body cabinet 3, a storage chamber 5 formed in the main body cabinet 3, a door 23 to open and close the storage chamber 5, illuminators 15 and 15' which are provided in the storage chamber 5 to illuminate the storage chamber 5, and a controller 45 controlling the illuminators 15 and 15' to turn the illuminators 15 and 15' on and off.

The main body cabinet 3 forms an external appearance of the refrigerator 1 and has the storage chamber 5 therein. The door 23 is coupled with a front surface of the main body cabinet 3 to open and close the storage chamber 5.

As an example of the present embodiment, the storage chamber 5 is a side-by-side type divided into left and right sides by a main wall 11. The storage chamber 5 is divided into a freezing compartment 7 which preserves and freezes stored items at a temperature below freezing point, and a refrigerating compartment 9 which preserves and refrigerates other stored items.

A plurality of shelves 13 is provided in the storage chamber 5 to divide the storage chamber 5 into a plurality of parts and manage the stored items easily.

The illuminators 15 and 15' are provided in a rear wall of the storage chamber 5 to illuminate the storage chamber 5.

The illuminators 15 and 15' according to the present embodiment include light emitters 15*a*, 15*b* and 15*c* arranged at constant intervals in a transverse direction, for example, of the storage chamber 5 to illuminate the storage chamber 5 in three different colors, for example. However, the light emitters may illuminate the storage chamber 5 is less than or more than three different colors. The plurality of light emitters 15*a*, 15*b* and 15*c* which illuminates in the same color is arranged in a row in upward and downward directions of the storage chamber 5. Each of the light emitters 15*a*, 15*b* and 15*c* which illuminate in three different colors may be provided in the rear wall of the storage chamber 5. The light emitters 15*a*, 15*b* and 15*c* may include one of a light emitting diode and a lamp, for example. However, while the light emitters 15*a-c* are shown in the current embodiment as being disposed in a transverse direction, the light emitters 15*a-c* may be disposed within the storage chamber 5 in any direction or manner such that a user may view the light emitters 15*a-c*.

The light emitters 15*a*, 15*b* and 15*c* are covered by a cover 17 which is made of a transparent material, for example, and is detachably attached to the rear wall of the storage chamber 5. A plurality of cooling air dischargers 19 is formed in the cover 17 to discharge cooling air to the storage chamber 5.

The door 23 is coupled with the main body cabinet 3 by a hinge to open and close the storage chamber 5 leftwards and rightwards. The door 23 includes a freezing compartment door 25 to open and close the freezing compartment 7 and a refrigerating compartment door 27 to open and close the refrigerating compartment 9.

A freezing compartment door detector 29 and a refrigerating compartment door detector 29' are respectively provided in a front surface of the freezing compartment door 25 and the refrigerating compartment door 27 to detect the opening and closing of the freezing compartment 7 and the refrigerating compartment 9.

A dispenser 31 is provided in the front surface of the freezing compartment door 25 to dispense water or ice from the outside.

An input unit 33 is provided above the dispenser 31 to set a color of the illuminators 15 and 15'.

The input unit 33 includes a display panel 35 to display a temperature of the storage chamber 5 and an input button 37 to set a color of the illuminators 15 and 15'.

Three input buttons 37 are provided according to the first embodiment. Alternatively, the number of the input buttons 37 corresponds to the colors of the light emitters 15*a*, 15*b* and 15*c*. While three input buttons are shown, multiple input buttons or a single input button may be provided to set the color(s) of the illuminators 15 and 15'. In addition, any other type of input mechanism, for example, a rotary knob or a touch display may be used as an input to set the color(s) of the illuminators 15 and 15'.

The refrigerator 1 according to the present embodiment includes the controller 45 which stores a setting value of the light emitters 15*a*, 15*b* and 15*c* of the illuminators 15 and 15' set through the input unit 33, and controls the light emitters 15*a*, 15*b* and 15*c* according to the setting value to turn on and off the light emitters 15*a-c*.

With the foregoing configuration, if a user opens the freezing compartment door 25 during the operation of the refrigerator 1, the controller 45 turns on the set light emitter among the light emitters 15*a*, 15*b* and 15*c* provided in the freezing compartment 7, by the opening signal of the freezing compartment door detector 29.

If a user resets the setting value of the color of the illuminators 15 and 15' through the input unit 33, the controller 45 may turn on the light emitter corresponding to the reset setting value.

The refrigerator 1 according to the present embodiment may easily adjust the illumination color of the storage chamber 5 set during a manufacturing process, and thereby enhance user friendliness and an emotional quality of a user by selecting the setting value of the illuminators 15 and 15' through the input unit 33.

The illuminators 15 and 15' may be provided as a single light emitter, for example.

If the illuminators 15 and 15' are provided as a single light emitter, the controller 45 may control the illuminators 15 and 15' to change at least one of hue saturation and brightness of the illuminators 15 and 15' according to the setting value set through the input unit 33. The single light emitter may be shaped like a bar graph or a fan, for example, and have various illumination areas according to the setting value set through the input unit 33.

The embodiments apply to the freezing compartment 7, but are not limited thereto. The present embodiments may applicable to the refrigerating compartment 9.

Figure 5:
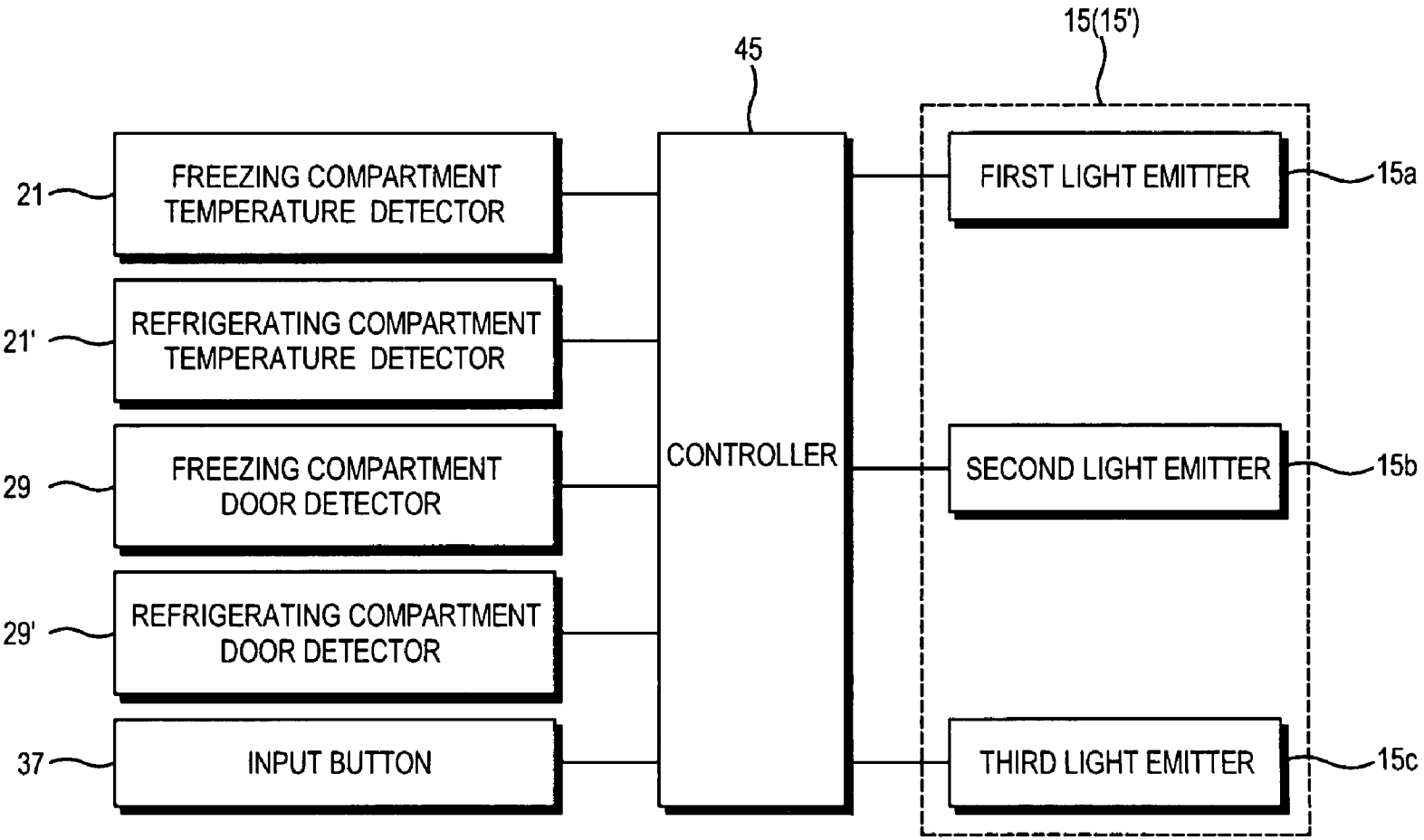
FIG. 5 is a control block diagram of a refrigerator according to a second embodiment.

FIG. 5 is a control block diagram of a refrigerator 1 according to a second embodiment. The refrigerator 1 according to the second embodiment further includes a temperature detector 21 and 21' to detect a temperature of a storage chamber 5.

Illuminators 15 and 15' have different setting values depending on the temperature of the storage chamber 5 to illuminate the storage chamber 5.

The temperature detector is provided in a freezing compartment 7 and a refrigerating compartment 9, respectively. The temperature detector includes a freezing compartment temperature detector 21 and a refrigerating compartment temperature detector 21' to respectively detect a temperature of the freezing compartment 7 and the refrigerating compartment 9.

The controller 45 may store a predetermined temperature range and a setting value corresponding to the temperature range instead of storing a particular temperature value and a setting value corresponding thereto. For example, it is assumed that the storage chamber 5 of the refrigerator 1 is 17 to 25 degrees below zero in Celsius. Then, a first setting value may correspond to 17 to 19 degrees below zero in Celsius, for example. A second setting value may correspond to 20 to 22 degrees below zero in Celsius and a third setting value may correspond to 23 to 25 degrees below zero in Celsius, for example. The first, second and third setting values may be stored in the controller 45.

Based on the temperature detected by the temperature detectors 21 and 21', the controller 45 determines the stored temperature range, reads the setting value corresponding to the determined temperature range and turns on the light emitter among the light emitters 15*a*, 15*b* and 15*c* corresponding to the read setting value.

With the foregoing configuration, the refrigerator 1 whose freezing compartment 7 is 17 to 25 degrees below zero in Celsius will be described.

Hereinafter, the freezing compartment 7 will be described as a storage chamber 5 for convenience. The present embodiment may also be applicable to the refrigerating compartment 9.

A plurality of light emitters 15*a*, 15*b* and 15*c*, which illuminates yellow, blue and white light, respectively, for example, corresponding to the temperature of the freezing compartment 7 are provided in the rear wall of the freezing compartment 7. However, the light emitters 15*a-c* may be any of a number of colors.

The controller 45 has a first setting value to transmit a signal to the yellow light emitter 15*a* when the freezing compartment 7 is 17 to 19 degrees below zero in Celsius, a second setting value to transmit a signal to the blue light emitter 15*b* when the freezing compartment 7 is 20 to 22 degrees below zero in Celsius and a third setting value to transmit a signal to the white light emitter 15*c* when the freezing compartment 7 is 23 to 25 degrees below zero in Celsius. The controller 45 is electrically connected with the respective light emitters 15*a*, 15*b* and 15*c* to turn on and off the light emitters 15*a*, 15*b* and 15*c* emitting different lights respectively corresponding to the setting values.

The controller 45 is electrically connected with the freezing compartment temperature detector 21 and the freezing compartment door detector 29. The freezing compartment temperature detector 21 detects the temperature of the freezing compartment 7 on a regular basis while the refrigerator 1 operates, and transmits a temperature detecting signal to the controller 45.

If a user opens the freezing compartment door 25 while the refrigerator 1 operates, the controller 45 turns on one of the light emitters 15*a*, 15*b* and 15*c* of the freezing compartment 7 by the opening signal of the freezing compartment door detector 29. The controller 45 determines the stored temperature range, reads the setting value corresponding to the determined temperature range and turns on one of the light emitters 15*a*, 15*b* and 15*c* corresponding to the read setting value, based on the temperature detected by the freezing compartment temperature detector 21 of the freezing compartment 7. That is, if the temperature detected by the freezing compartment temperature detector 21 is 18 degrees below zero in Celsius, the controller 45 determines that the temperature range of the freezing compartment 7 is 17 to 19 degrees below zero in Celsius. Then, the controller 45 reads the first setting value corresponding to the determined temperature range and turns on the yellow light emitter 15*a*, for example.

If a user opens the freezing compartment door 25, he/she is able to view the freezing compartment 7 illuminated by the yellow light emitter 15*a*. Then, a user may recognize that the freezing compartment 7 is 17 to 19 degrees below zero in Celsius. If the freezing compartment 7 is illuminated by the blue light emitter 15*b*, a user may recognize that the freezing compartment 7 is 20 to 22 degrees below zero in Celsius, for example. Likewise, if the freezing compartment 7 is illuminated by the white light emitter 15*c*, a user may recognize that the freezing compartment 7 is 23 to 25 degrees below zero in Celsius, for example. That is, a user may easily determine the temperature state of the freezing compartment 7 according to the illumination color of the light emitters 15*a*, 15*b* and 15*c*. A user may determine the particular temperature value of the freezing compartment 7 detected by the freezing compartment temperature detector 21 through the display panel 35 provided in the front surface of the freezing compartment door 25.

In the refrigerator 1 according to the present embodiment, a user may reset the temperature of the freezing compartment 7 and the setting value of the colors of the illuminators corresponding thereto through the input unit 33 to thereby change the illumination of the freezing compartment 7 according to his/her preference.

For example, if a user wants the white light emitter 15*c* of the freezing compartment 7 to be illuminated at 17 to 19 degrees below zero in Celsius, he/she selects the temperature range through the input button 37 of the input unit 33, selects the white light emitter 15*c* and then presses the input button 37 to thereby change the illumination color of the freezing compartment 7 according to the temperature of the freezing compartment 7.

Thus, a user may easily change the illumination of the illuminators 15 and 15' according to the temperature of the freezing compartment 7 and the user's preference.

Alternatively, the light emitters 15*a-c* of the illuminators 15 and 15' may emit light based on hue saturation or brightness. For example, each of the light emitters 15*a-c* may emit the same color, but emit the color at different levels of hue saturation or brightness.

According to the a third embodiment, the illuminators 15 and 15' include the plurality of light emitters 15*a*, 15*b* and 15*c* illuminating in different colors, but the embodiment is not limited thereto. Alternatively, the illuminators 15 and 15' may include a single light emitter. In this case, the controller 45 may control the illuminators 15 and 15' to change at least one of hue saturation and brightness of the illuminators 15 and 15' according to the setting value corresponding to the temperature detected by the temperature detectors 21 and 21'. The single light emitter may be shaped like a bar graph or a fan, for example, but may be shaped in any manner to convey light, and have different light emitting areas depending on the setting value corresponding to the temperature of the temperature detector 21 and 21' to thereby determine the temperature state of the storage chamber 5.

According to the embodiments, a user resets the temperature of the storage chamber and the setting value of the illumination colors of the illuminators through the input unit to change the illumination of the illuminators according to the temperature of the storage chamber, but the embodiments are not limited thereto. Alternatively, a user may set the brightness of the illuminator according to daytime, nighttime and power consumption through the input unit to change the illumination of the illuminators corresponding thereto. A user may set the illumination of the illuminators according to the storage chamber, the time and the season through the input unit to change the illumination of the illuminators corresponding thereto. A user may set the hue saturation of the illuminator according to the temperature, the storage chamber, day and night and the season through the input unit to change the illumination of the illuminators corresponding thereto.

While the present embodiments have been described to cause the illuminator to illuminate in at least one of a color, a hue saturation and a brightness based on the temperature of the storage chamber in which the illuminator is located, the illuminator may be illuminated in at least one of a color, a hue saturation and a brightness based on any other type of measurement of the storage chamber. For example, the measurement of the storage chamber may be based on the humidity in the storage chamber.

As described above, the present embodiments provide a refrigerator which easily changes an illumination color of a storage chamber according to a user's preference and enhances user friendliness and emotional quality.

Also, the present embodiments provide a refrigerator which changes an illumination of an illuminator according to a temperature of a storage chamber to easily determine a temperature state of the storage chamber.

Although a few embodiments have been shown and described, it will be appreciated by those skilled in the art that changes may be made in these embodiments without departing from the principles and spirit of the invention, the scope of which is defined in the appended claims and their equivalents.

What is claimed is:

1. A refrigerator, comprising:

a main body cabinet forming at least one storage chamber therein to store items to be cooled;

at least one illuminator provided in the storage chamber illuminating an inside of the storage chamber;

an input unit setting at least one of a color, a hue saturation and a brightness of the illuminator; and a controller storing at least one setting value set through the input unit and controlling the illuminator according to the setting value, wherein the input unit sets the brightness of the illuminator to vary depending on at least one of daytime, nighttime and power consumption.

2. The refrigerator according to claim 1, further comprising a temperature detector detecting a temperature of the storage chamber, wherein the at least one illuminator has at least one setting value of color, hue saturation and brightness changed according to a temperature input through the input unit and illuminates the storage chamber corresponding thereto.

3. The refrigerator according to claim 1, wherein the at least one illuminator comprises a plurality of light emitters, each light emitter emitting a different color of light, and the controller controls the at least one illuminator to illuminate the storage chamber in different colors according to the at least one setting value set through the input unit.

4. The refrigerator according to claim 1, wherein the input unit sets the color of the at least one illuminator to vary depending on at least one of temperature, storage chamber, time and season.

5. The refrigerator according to claim 1, wherein the at least one illuminator comprises a plurality of light emitters, each light emitter emitting a different color of light, and the input unit sets the hue saturation of the at least one illuminator to vary depending on at least one of temperature, storage chamber, day or night, and season.

* * * * *